US007462094B2

(12) United States Patent
Yoshida et al.

(10) Patent No.: US 7,462,094 B2
(45) Date of Patent: Dec. 9, 2008

(54) WAFER GRINDING METHOD

(75) Inventors: Shinji Yoshida, Ota-ku (JP); Osamu Nagai, Ota-ku (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/901,907

(22) Filed: Sep. 19, 2007

(65) Prior Publication Data

US 2008/0076334 A1 Mar. 27, 2008

(30) Foreign Application Priority Data

Sep. 26, 2006 (JP) ..... 2006-261252

(51) Int. Cl.
*B24B 1/00* (2006.01)

(52) U.S. Cl. ..... 451/41; 451/58; 451/63; 451/287

(58) Field of Classification Search ..... 451/41, 451/57, 58, 63, 65, 278, 285, 287, 290
See application file for complete search history.

(56) References Cited

U.S. PATENT DOCUMENTS 7,037,755 B2 * 5/2006 Enquist ..... 438/109
7,060,618 B2 * 6/2006 Inoue et al. ..... 438/687
2006/0040586 A1 * 2/2006 Arai ..... 451/5

FOREIGN PATENT DOCUMENTS

JP 2003-273053 9/2003
JP 2006-108532 4/2006

* cited by examiner

*Primary Examiner*—Eileen P. Morgan
(74) *Attorney, Agent, or Firm*—Greer, Burns & Crain, Ltd.

(57) ABSTRACT

A wafer grinding method is disclosed, in which only a region, corresponding to a device formation region, of the back side of a wafer is ground in rough grinding conducted first, while the part surrounding the region thus ground is left unground as an annular projected part, to prevent the outer peripheral edge of the wafer from becoming knife edge-like in shape. In the subsequent finish grinding, the annular projected part is ground and, further, the whole area of the back side of the wafer is ground to be flat. Chippings of the outer peripheral edge may be generated only during the finish grinding, whereby the chippings are prevented from occurring or limited to minute ones.

2 Claims, 7 Drawing Sheets

WAFER GRINDING METHOD

BACKGROUND OF THE INVENTION

1. Field of the Invention

The present invention relates to a grinding method for grinding the back side of a wafer such as a semiconductor wafer to thin the wafer to a predetermined thickness, and particularly to an improving technology for minimizing the chipping of the outer peripheral edge of a wafer generated when the back side of the wafer is ground.

2. Description of the Related Art

In general, semiconductor chips of devices used for various electronic apparatus are each produced by a method in which rectangular regions are demarcated on the face side of a circular disk-like semiconductor wafer in a lattice pattern by planned splitting lines, electronic circuits such as ICs and LSIs are formed on the face side of these regions, then the back side of the wafer is ground to thin the wafer, and the wafer is cut and split (diced) along the planned splitting lines.

Meanwhile, since the wafer with its back side to be ground is preliminarily subjected to chamfering of the outer peripheral edge, the outer peripheral edge becomes knife edge-like in sectional shape after the wafer is thinned to or below one half of the original thickness, and, therefore, the outer peripheral edge is liable to be chipped during grinding. The chipping of the outer peripheral edge becomes a starting point of breakage, thereby serving as a major cause of lowering in the yield of the wafer; therefore, there is a need to restrain the chipping as securely as possible. In view of this, there is known a technology for restraining the generation of chipping by removing the knife edge-like outer peripheral edge at a stage before grinding (refer to Japanese Patent Laid-open No. 2003-273053 and Japanese Patent Laid-open No. 2006-108532).

According to the technology in the related art, the removal of the outer peripheral edge of a wafer before grinding is conducted by cutting in with a cutting edge of a dicing device or by irradiation with a laser beam using a laser beam machining device. Each of these devices is separate from the wafer grinding device, so that the wafer before being ground is set onto the device and its outer peripheral edge is removed, before the wafer is set onto the grinding device. More specifically, the step of removing the outer peripheral edge of the wafer at a stage before grinding of the back side of the wafer is added, and a device for this purpose is needed, which leads to a lowering in productivity and a rise in cost.

SUMMARY OF THE INVENTION

Accordingly, it is an object of the present invention to provide a wafer grinding method by which a processing for minimizing the generation of chipping of the outer peripheral edge of a wafer can be performed before a grinding step and without using any step or device other than that for grinding, with the result that an enhanced yield can be contrived without causing a lowering in productivity or a rise in cost.

In accordance with an aspect of the present invention, there is provided a method of grinding a wafer having a device formation region provided with a plurality of devices on the front side thereof, the method including: a first grinding step of holding the wafer on a rotatable chuck table with its back side exposed, and grinding a region, corresponding to the device formation region, of the back side by a rotating type first grindstone or grindstones being annular in shape or arranged in an annular pattern so as to form a recess on the back side of the wafer and to form an annular projected part projected to the back side in the periphery of the device formation region; and a second grinding step of grinding the whole area of the back side of the wafer inclusive of the annular projected part by a rotating type second grindstone or grindstones being smaller in abrasive grain diameter than the first grindstone(s) and being annular in shape or arranged in an annular pattern so as to flatten the back side.

In the grinding method based on the present invention, in grinding the back side of a wafer, most of the total grinding amount is ground in the first grinding step, and the remaining tiny amount of the total grinding amount is ground in the second grinding step to thereby finish the back side of the wafer into a flat state. Therefore, the first grindstone(s) used in the first grinding step has a comparatively coarse grain size, while the second grindstone(s) used in the second grinding step has a finer grain size suitable for finishing.

The chipping of the outer peripheral edge, which is the problem to be solved by the present invention, is liable to be generated at the time of rough grinding in the first grinding step. However, in the first grinding step based on the present invention, only the region, corresponding to the device formation region, of the back side of the wafer is ground to form the recess and, at the same time, the periphery of the device formation region is left unground (left in the original thickness) to thereby form the annular projected part. Thus, in the first grinding step, the outer peripheral edge is not ground, so that chipping of the outer peripheral edge is not generated; therefore, the region corresponding to the device formation region, which is a major part of the wafer, can be roughly ground without any trouble.

Next, in the second grinding step, the annular projected part is ground in a collapsing manner by the second grindstone(s), to remove the annular projected part, and further the whole area of the back side of the wafer is ground to finish the back side into a flat state. Since the grinding amount relevant to the annular projected part is small and the grinding resistance in this instance is small, the grinding of the annular projected part can be conducted even with the second grindstone(s) for finishing. Due to the grinding with the second grindstone(s) for finishing, chipping of the outer peripheral edge would not be generated easily and, even if the chipping is generated, the depth of chipping is much smaller than that which might be generated during rough grinding, so that the influence of the chipping to the device formation region can be restrained.

As above-mentioned, in the grinding method based on the present invention, only the region, corresponding to the device formation region, of the back side of the wafer is first ground so that the part in the periphery of the device formation region, inclusive of the outer peripheral edge which is susceptible to chipping, is left unground as an annular projected part (first grinding step), and then the annular projected part is ground and further the whole area of the back side is made flat (second grinding step). Ordinarily, chipping of the outer peripheral edge is liable to be generated in the first grinding step which is a rough grinding step. In the method based on the present invention, the outer peripheral edge is not ground in the first grinding step, so that chipping of the outer peripheral edge is not generated. Besides, since the grinding in the second grinding step is finish grinding, chipping of the outer peripheral edge is not liable to be generated. According to the grinding method based on the present invention, there is adopted such a processing method as to restrain the generation of chipping of the outer peripheral edge in the grinding process, whereby generation of chipping of the outer peripheral edge can be restrained as securely as possible, without using any step or device other than that for grinding, such as a step or device for cutting.

The first grindstone(s) used in the first grinding step is one with which only the region, corresponding to the device formation region, of the back side of the wafer can be ground while leaving the outer peripheral part unground. For this purpose, the diameter of the first grindstone(s) is smaller than the radius of the wafer and is comparable to or greater than the radius of the device formation region. The first grindstone(s) is disposed opposite to the wafer rotated by the chuck table so that the outer peripheral edge of the first grindstone(s) passed through the outer peripheral edge of the device formation region and the vicinity of the center of rotation of the wafer, and, starting from this condition, the wafer is pressed, whereby only the region corresponding to the device formation region is ground appropriately.

According to the method based on the present invention, since grinding is conducted in such a manner as to restrain the generation of chipping of the outer peripheral edge of the wafer in the grinding process, chipping of the outer peripheral edge can be restrained as securely as possible, without using any step or device other than that for grinding, such as a step or device for cutting. As a result, in the process of grinding the back side of a wafer, an enhanced yield can be contrived without causing a lowering in productivity or a rise in cost.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENT

Figure 1A:
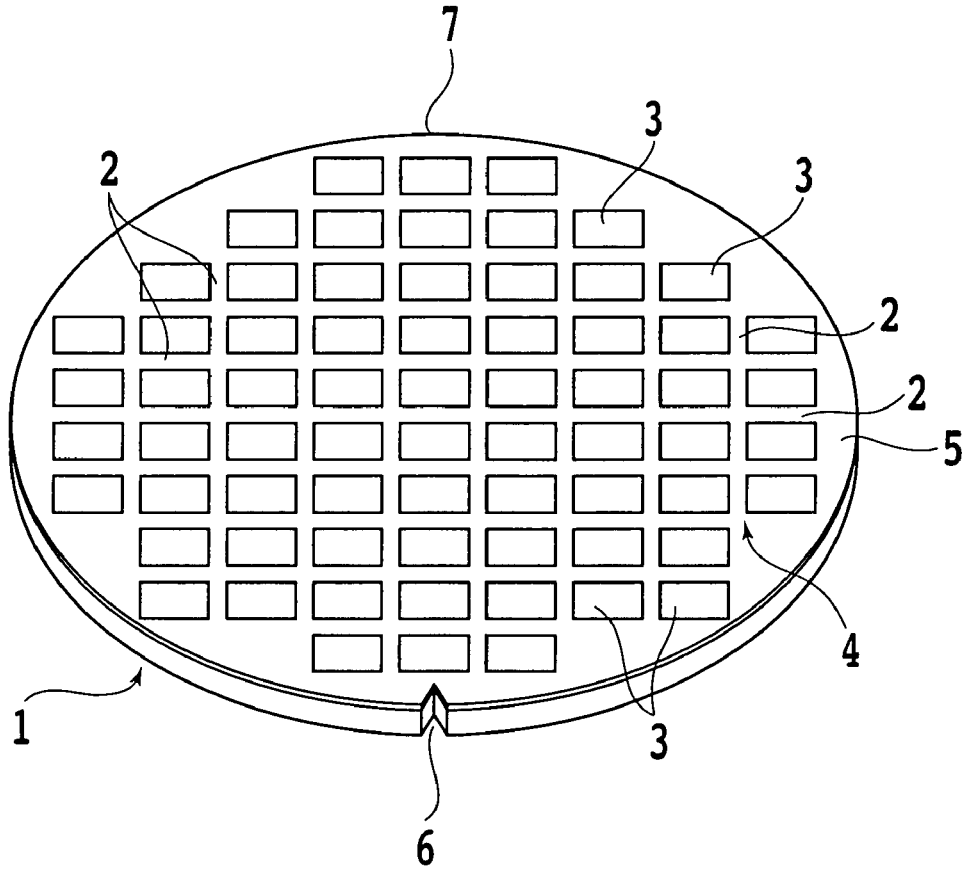
FIG. 1A is a perspective view of a wafer of which the back side is to be ground by the wafer grinding method based on the present invention.

Now, one embodiment of the present invention will be described below referring to the drawings.

[1] Semiconductor Wafer

Symbol 1 in FIGS. 1A and 2B denotes a circular disk-like semiconductor wafer (hereinafter referred to simply as wafer) of which the whole area of the back side is to be ground by the wafer grinding method according to the one embodiment to be thinned to an objective thickness. The wafer 1 is a silicon wafer or the like, and its thickness before processing is about 600 to 700 μm, for example. On the face side of the wafer 1, a plurality of rectangular semiconductor chips (devices) 3 are demarcated by planned splitting lines 2 formed in a lattice pattern, and electronic circuits (not shown) such as ICs and LSIs are formed on the surfaces of the semiconductor chips 3. The outer peripheral edge of the wafer 4 is chamfered into a semicircular arc sectional shape so as to eliminate corners and to lower the possibility of damage thereto.

The plurality of semiconductor chips 3 are formed in a generally circular device formation region 4 concentric with the wafer 1. The device formation region 4 occupies most of the wafer 1, and a wafer peripheral part in the periphery of the device formation region 4 constitutes an annular outer peripheral marginal region 5 where no semiconductor chip 3 is formed. In addition, the peripheral surface of the wafer 1 is provided at a predetermined position with a V-shaped notch 6 for indicating the crystal orientation of the semiconductor. The notch 6 is formed in the outer peripheral marginal region 5. The wafer 1, finally, is cut and split along the planned splitting lines 2, to be diced into the plurality of semiconductor chips 3. The wafer grinding method according to this embodiment is a method of thinning by grinding the whole area of the back side of the wafer 1 at a stage before the dicing into the semiconductor chips 3.

Figure 1B:
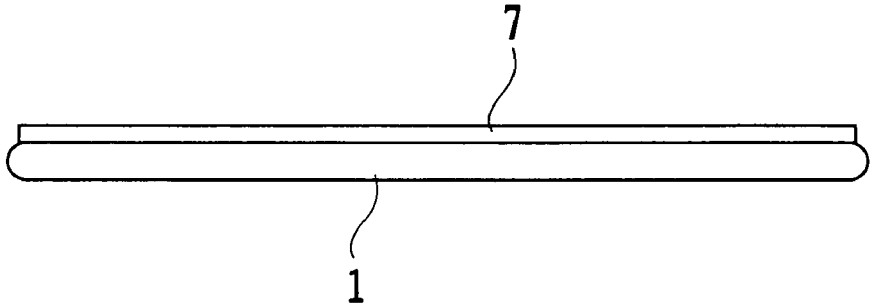
FIG. 1B is a side view of the same.

In grinding the back side of the wafer 1, a protective tape 7 is adhered to the face side on which electronic circuits are formed, as shown in FIGS. 1A and 1B, for the purpose of protecting the electronic circuits or the like purpose. As the protective tape 7, for example, there is used a tape in which one side of a base sheet made of a flexible resin such as polyolefin and having a thickness of about 70 to 200 μm is coated with a pressure sensitive adhesive in a thickness of about 5 to 20 μm. The protective tape 7 is adhered to the wafer 1, with the pressure sensitive adhesive facing to the face side of the wafer 1.

[2] Configuration of Wafer Grinding Device

Figure 2:
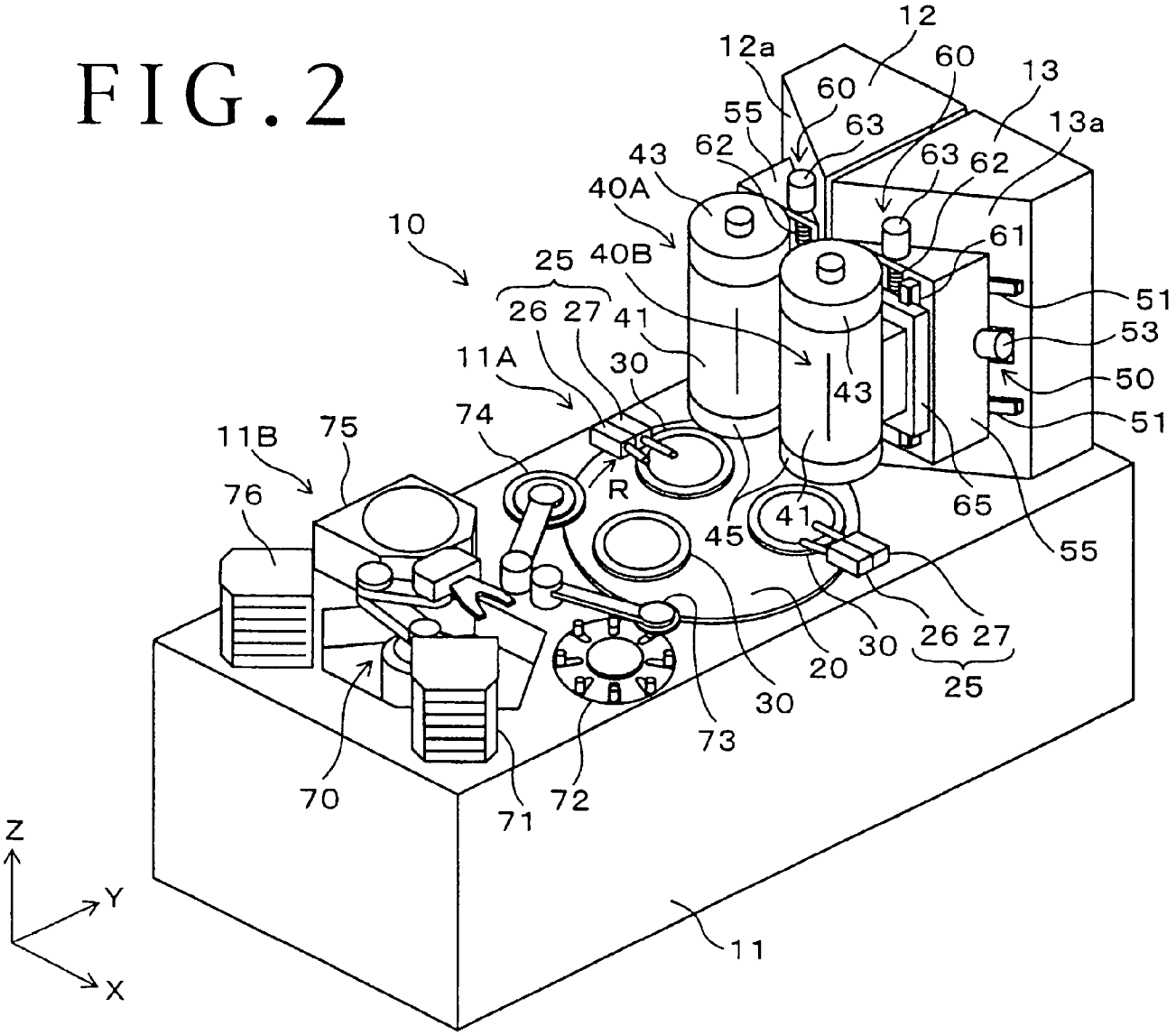
FIG. 2 is a perspective view of a grinding device with which the wafer grinding method based on the present invention can be carried out suitably.

Now, the wafer grinding device with which the method according to this embodiment can be carried out suitably will be described below. FIG. 2 generally shows the wafer grinding device 10, which has a rectangular parallelopiped base 11 with its top face set horizontal. In FIG. 2, the longitudinal direction of the base 11, the horizontal width direction orthogonal to the longitudinal direction, and the vertical direction are made to be the Y direction, the X direction, and the Z direction, respectively. On one end part in the Y direction of the base 11, a pair of columns 12 and 13 arranged side by side in the X direction (here, the left-right direction) are erected. The base 11 is provided thereon with a machining area 11A for grinding the wafer 1, on the side of the columns 12 and 13 in the Y direction, and with an attaching/detaching area 11B for supplying an unmachined wafer 1 to the machining area 11A and recovering the machined wafer 1, on the opposite side of the columns 12 and 13 in the Y direction.

A circular disk-like turntable 20 with its rotational axis set parallel to the Z direction and with its top face set horizontal is rotatably provided in the machining area 11A. The turntable 20 is rotated in the direction of arrow R by a rotational driving mechanism (not shown). On an outer peripheral part of the turntable 20, a plurality of circular disk-like chuck tables 30 each having a rotational axis set parallel to the Z direction and having the top face there of set horizontal are rotatably disposed at regular intervals in the circumferential direction.

The chuck tables 30 are of the generally known vacuum chuck system for holding the wafer 1 on the top face thereof by suction. Each of the chuck tables 30 is independently rotated (about its axis) in one direction or in both directions by a rotational driving mechanism (not shown) and is revolved (around the center of the turntable 20) when the turntable 20 is rotated.

In the condition where the two chuck tables 30 are arranged side by side in the X direction on the side of the columns 12 and 13 as shown in FIG. 2, a rough grinding unit (first grinding means) 40A and a finish grinding unit (second grinding means) 40B are disposed sequentially from the upstream side with regard to the rotating direction of the turntable 20, directly above the chuck table 30. By intermittent rotation of the turntable 20, each of the chuck tables 30 is located in one of three positions consisting of a rough grinding position on the lower side of the rough grinding unit 40A, a finish grinding position on the lower side of the finish grinding unit 40B, and an attaching/detaching position which is the nearest to the attaching/detaching area 11B.

The rough grinding unit 40A and the finish grinding unit 40B are mounted respectively to the columns (the column 12 on the rough grinding side, and the column 13 on the finish grinding side). The structures for attaching the rough grinding unit 40A and the finish grinding unit 40B to the columns 12 and 13 are the same and symmetrical (on a left-right basis) in the X direction. In view of this, referring to FIG. 2, the attaching structure on the finish grinding side will be described below representatively.

A front face 13*a*, facing to the machining area 11A, of the column 13 on the finish grinding side is vertical to the top face of the base 11, and is a tapered surface inclined at a predetermined direction so that it is retracted to the depth side (the side opposite to the attaching/detaching area 11B) as one goes from the center in the X direction toward an end part. The horizontal direction, or taper direction, of the tapered surface 13*a* (the tapered surface 12*a* in the case of the column 12 on the rough grinding side) is set parallel to the straight line connecting the rotational center of the chuck table 30 located in the finish grinding position and the rotational center of the turntable 20 to each other. An X-axis slider 55 is mounted to the tapered surface 13*a* through an X-axis feeding mechanism 50, and a Z-axis slider 65 is mounted to the X-axis slider 55 through a Z-axis feeding mechanism 60.

The X-axis feeding mechanism 50 includes an upper-lower pair of guide rails 51 fixed to the tapered surface 13*a* (12*a*), a screw rod (not shown) disposed between the guide rails 51 and penetrating the X-axis slider 55 in screw engagement with the latter, and a motor 53 for rotating the screw rod in normal and reverse directions. The guide rails 51 and the screw rod extend in parallel to the taper direction of the tapered surface 13*a* (12*a*), and the X-axis slider 55 is slidably mounted to the guide rails 51. The X-axis slider 55 is reciprocated along the guide rails 51 as the power of the screw rod rotated by the motor 53 is transmitted thereto. The reciprocating direction of the X-axis direction 55 is parallel to the direction in which the guide rails 51 extend, i.e., to the taper direction of the tapered surface 13*a* (12*a*).

A front face of the X-axis slider 55 is a surface along the X-Z direction, and the Z-axis feeding mechanism 60 is provided on the front face. The Z-axis feeding mechanism 60 has a configuration as if obtained by changing the feeding direction of the X-axis feeding mechanism 50 into the Z direction. The Z-axis feeding mechanism 60 includes a left-right pair of guide rails 61 (only one on the right side is seen in FIG. 2) fixed to the front face of the X-axis slider 55 and extending in the Z direction, a screw rod 62 disposed between the guide rails 61, penetrating the Z-axis slider 65 in screw engagement with the latter and extending in the Z direction, and a motor 63 for rotating the screw rod 62 in normal and reverse directions. The Z-axis slider 65 is slidably mounted to the guide rails 61, and is moved up and down along the guide rails 61 by the power of the screw rod 62 rotated by the motor 63.

A front face 12*a*, facing to the machining area 11A, of the column 12 on the rough grinding side is formed as a tapered surface inclined at a predetermined direction to be retracted as one goes from the center in the X direction toward an end part, in left-right symmetry with the column 13 on the finish grinding side. The X-axis slider 55 is mounted to the tapered surface 12*a* through the X-axis feeding mechanism 50, and the Z-axis slider 65 is mounted to the X-axis slider 55 through the Z-axis feeding mechanism 60. The taper direction of the tapered surface 12*a* of the column 12 on the rough grinding side is set parallel to a straight line connecting the rotational center of the chuck table 30 located in the rough grinding position and the rotational center of the turntable 20 to each other.

The rough grinding unit 40A and the finish grinding unit 40B are fixed respectively to the Z-axis sliders 65 mounted to the rough grinding side column 12 and the finish grinding side column 13.

Figure 3B:
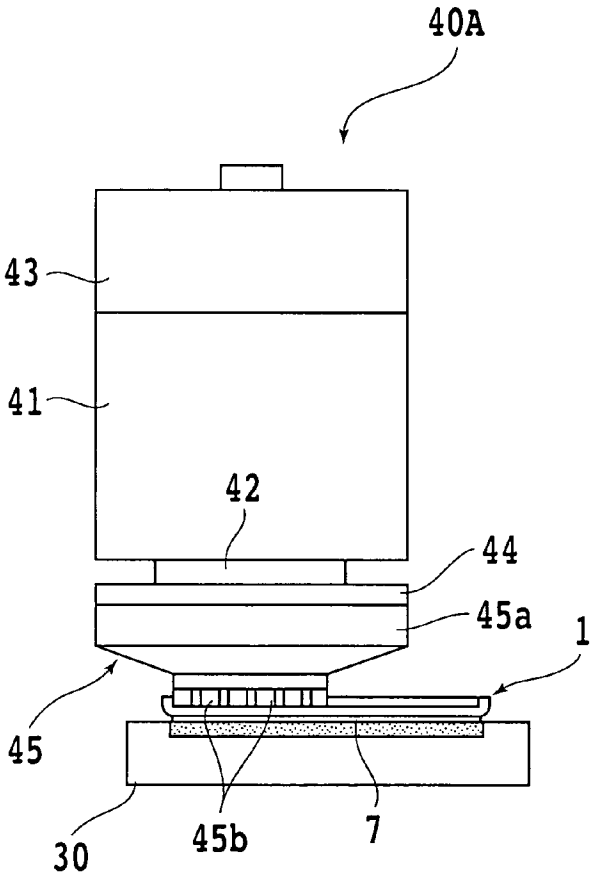
FIG. 3B is a side view of the same.
Figure 3A:
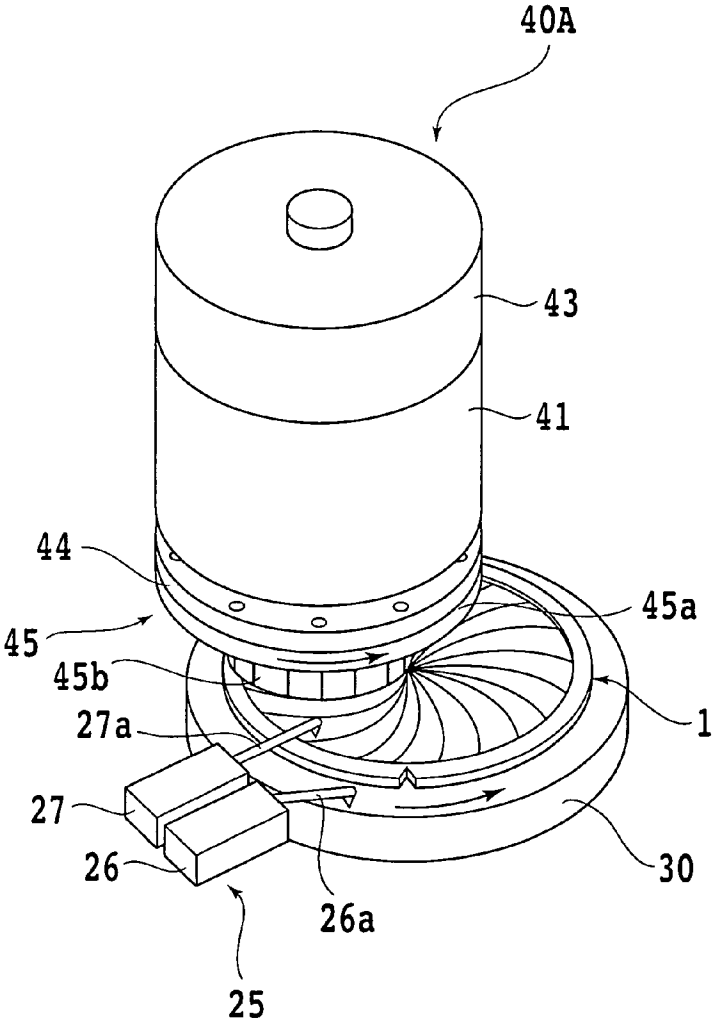
FIG. 3A is a perspective view showing a rough grinding unit possessed by the grinding device.

As shown in FIGS. 3A and 3B, the rough grinding unit 40A includes a hollow cylindrical spindle housing 41 having an axial direction extending in the Z direction, a spindle shaft 42 supported coaxially and rotatably in the spindle housing 41, a motor (rotational driving source) 43 fixed to an upper end part of the spindle housing 41 and operative to rotatingly drive the spindle shaft 42, and a circular disk-like flange 44 fixed coaxially to the lower end of the spindle shaft 42. A rough grinding wheel 45 is detachably attached to the flange 44 by such means as screwing.

The rough grinding wheel 45 has a configuration in which a plurality of rough grinding grindstones (first grindstones) 45*b* are arranged in an annular pattern on, and fixed to, the lower end face of a circular disk-like frame 45*a* having a conically shaped lower part, along the whole circumference of the outer peripheral part of the lower end face. The grindstone 45*b* is, for example, a grindstone obtained by firing a mixture of a vitreous sintering material called vitrified with diamond abrasive grains, and contains abrasive grains of preferably #320 to #400, for example. In the rough grinding stone 45, the outside diameter of grinding by the grindstones 45*b*, i.e., the diameter of the outer peripheral edge of the plurality of grindstones 45*b* is slightly smaller than the radius of the wafer 1 and is comparable to the radius of the device formation region 4. This size setting is for ensuring that, in grinding the back side of the wafer 1, the cutting edges of the grindstones 45*b* pass through the vicinity of the rotational center of the wafer 1 and the outer peripheral edge of the device formation region 4 so as to grind only the region corresponding to the device formation region 4.

Figure 4B:
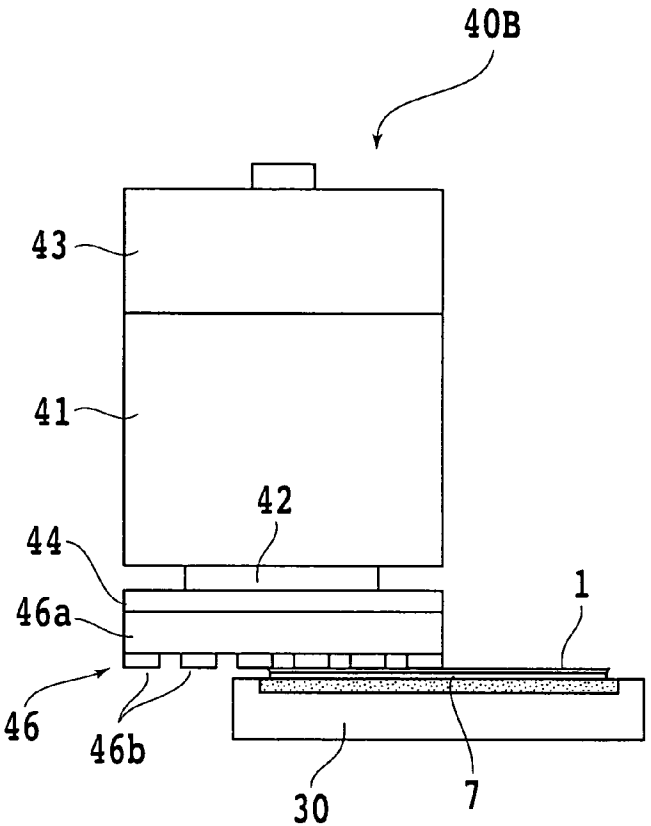
FIG. 4B is a side view of the same.
Figure 4A:
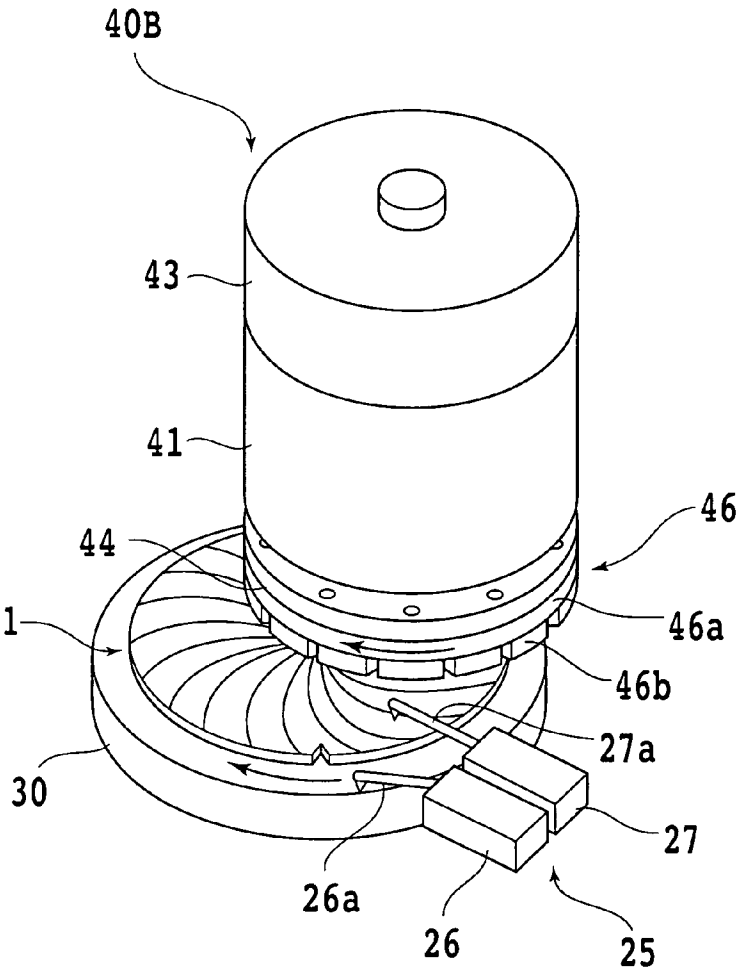
FIG. 4A is a perspective view of a finish grinding unit possessed by the grinding device.

On the other hand, the finish grinding unit 40B has a configuration similar to that of the rough grinding unit 40A. As shown in FIGS. 4A and 4B, the finish grinding unit 40B includes a spindle housing 41, a spindle shaft 42, a motor 43, and a flange 44, and a finish grinding wheel 46 is detachably attached to the flange 44. The finish grinding wheel 46 has a configuration in which a plurality of finish grinding grindstones (second grindstones) 46*b* are arranged in an annular pattern on, and fixed to, the lower end face of a circular disk-like frame 46*a* along the whole circumference of the outer peripheral part of the lower end face. The finish grinding grindstone 45*b* contains abrasive grains finer than those of the rough grinding grindstone 45*b*, and contains abrasive grains of preferably #2000 to #8000, for example. In the case of the finish grinding wheel 46, also, the grindstones 46*b* are so located that their cutting edges pass through the vicinity of the rotational center of the wafer 1. With regard to the grinding of the whole area of the back side of the wafer 1 being rotated, the outside diameter of grinding by the grindstones 46*b* is set to be in excess of the radius of the wafer 1.

The rough grinding unit 40A is so located that the rotational center of the rough grinding wheel 45 (the axis of the spindle shaft 42) is present directly above a straight line connecting the rotational center of the chuck table 30 located in the rough grinding position and the rotational center of the turntable 20 to each other. As the Z-axis slider 65 reciprocates, the rough grinding unit 40A is reciprocated along the taper direction of the tapered surface 12*a* of the column 12. Therefore, during the reciprocation, the rotational center of the rough grinding wheel 45 is reciprocated directly above the straight line connecting the rotational center of the chuck table 30 located in the rough grinding position and the rotational center of the turntable 20 to each other. Since this direction of reciprocation is in the direction between the axes of the chuck table 30 and the turntable 20, this reciprocating direction will be referred to as "inter-axial direction".

The position settings as above are the same also on the side of the finish grinding unit 40B. The rotational center of the finish grinding wheel 46 in the finish grinding unit 40B is present directly above a straight line connecting the rotational center of the chuck table 30 located in the finish grinding position and the rotational center of the turntable 20 to each other. When the finish grinding unit 40B is reciprocated along the taper direction of the tapered surface 13*a* of the column 13 together with the Z-axis slider 65 and the X-axis slider 55, the rotational center of the finish grinding wheel 46 is reciprocated directly above, and along the direction of, the straight line connecting the rotational center of the chuck table 30 located in the finish grinding position and the rotational center of the turntable 20, i.e., along the inter-axial direction.

As shown in FIG. 2, thickness gauges 25 for measuring the thicknesses of the wafers on the chuck tables 30 located respectively in the rough grinding position and the finish grinding position are disposed on the base 11. As shown in FIGS. 3A and 4A, the thickness gauges 25 each include a combination of a reference-side height gauge 26 and a wafer-side height gauge 27. The reference-side height gauge 26 has a configuration in which the tip of a swingable reference probe 26*a* makes contact with the upper surface of an outer peripheral part of the chuck table 30 not covered with the wafer 1, so as to detect the height position of the upper surface.

The wafer-side height gauge 27 has a configuration in which the tip of a swingable variation probe 27*a* makes contact with the upper side (ground side) of the wafer 1 held on the chuck table 30, so as to detect the height position of the upper side of the wafer 1. According to the thickness gauge 25, the thickness of the wafer 1 is measured based on the value obtained by subtracting the measurement by the reference-side height gauge 26 from the measurement by the wafer-side height gauge 27. Incidentally, the thickness measuring point of the wafer 1 with which the variation probe 27*a* of the wafer-side height gauge 27 makes contact is preferably an outer peripheral part near the outer peripheral edge of the wafer 1, as indicated by broken lines in FIGS. 3A and 4A.

While the configuration relating to the machining area 11A on the base 11 has been described above, the attaching/detaching area 11B will be described below referring to FIG. 2. A vertically movable two-node link type pickup robot 70 is disposed in the center of the attaching/detaching area 11B. A supply cassette 71, a position matching base 72, a supply arm 73, a recovery arm 74, a spinner-type cleaning device 75, and a recovery cassette 76 are disposed in the vicinity of the pickup robot 70, in this order counterclockwise as viewed from above.

The cassette 71, the position matching base 72 and the supply arm 73 constitute means for supplying the wafer 1 to the chuck table 30, whereas the recovery arm 74, the cleaning device 75 and the cassette 76 constitute a means for recovering the wafer 1 having undergone grinding of the back side from the chuck table 30 and transferring the wafer 1 to the subsequent step. Each of the cassettes 71 and 76 is for containing a plurality of wafers 1 in horizontal state and in the condition of being stacked at regular intervals in the vertical direction, and is set in a predetermined position on the base 11.

When one wafer 1 is taken out from the inside of the supply cassette 71 by the pickup robot 70, the wafer 1 is mounted on the position matching base 72 in the condition where the back side without any protective tape 7 adhered thereto is on the upper side, and the wafer 1 is located into a certain position here. Next, the wafer 1 is taken out from the position matching base 72 by the supply arm 73, and is mounted onto the chuck table 30 standing by at an attaching/detaching position.

On the other hand, the wafer 1 (on the chuck table 30) of which the back side has been ground by the grinding units 40A and 40B and which is located in the attaching/detaching position is taken out by the recovery arm 74, and is transferred to the cleaning device 75, where it is washed with water and dried. The wafer 1 thus cleaned by the cleaning device 75 is transferred and contained into the recovery cassette 76 by the pickup robot 70.

[3] Operation of Wafer Grinding Device

While the configuration of the wafer grinding device 10 has been described above, the operation of grinding the back side of the wafer 1 by the wafer grinding device 10 will be described below. This operation includes the wafer grinding method based on the present invention.

First, one wafer 1 contained in the supply cassette 71 is transferred to and positioned on the position matching base 72 by the pickup robot 70, and is then mounted by the supply arm 73 onto the chuck table 30, which is standing by at the attaching/detaching position and is suction-operated, with its back side up. By being positioned on the position matching base 72, the wafer 1 is disposed concentrically with the chuck table 30. The wafer 1 is held on the upper surface of the chuck table 30 by suction in the condition where the protective tape 7 on the face side of the wafer 1 is in close contact with the upper surface of the chuck table 30 and the back side of the wafer 1 is exposed.

Next, the turntable 20 is rotated in the direction of arrow R in FIG. 2, and the chuck table 30 holding the wafer 1 thereon is stopped at the rough grinding position directly below the rough grinding unit 40A. In this instance, the next chuck table 30 is located at the attaching/detaching position, and the wafer 1 to be ground next is set on the chuck table 30 in the above-mentioned manner.

In relation to the wafer 1 thus located in the rough grinding position, the thickness gauge 25 and the rough grinding unit 40A are set in the following manner. In the thickness gauge 25, the tip of the reference probe 26*a* of the reference-side height gauge 26 is put into contact with the upper surface of the chuck table 30, and the tip of the variation probe 27*a* of the wafer-side height gauge 27 is put into contact with the region, corresponding to the device formation region 4 and to be subjected to rough grinding, of the upper side of the wafer 1 held on the chuck table 30.

The rough grinding unit 40A is appropriately moved in the inter-axial direction by the X-axis feeding mechanism 50, and, as shown in FIGS. 3A and 3B, in relation to the back side of the wafer 1, the rough grinding wheel 45 is located in a recess formation permitting position such that the cutting edges of the grindstones 45*b* pass through the vicinity of the rotational center of the wafer 1 and the inner peripheral edge of the outer peripheral marginal region 5. In this case, the recess formation permitting position is on the outer periphery side of the turntable 20 relative to the rotational center of the wafer 1.

Figure 5:
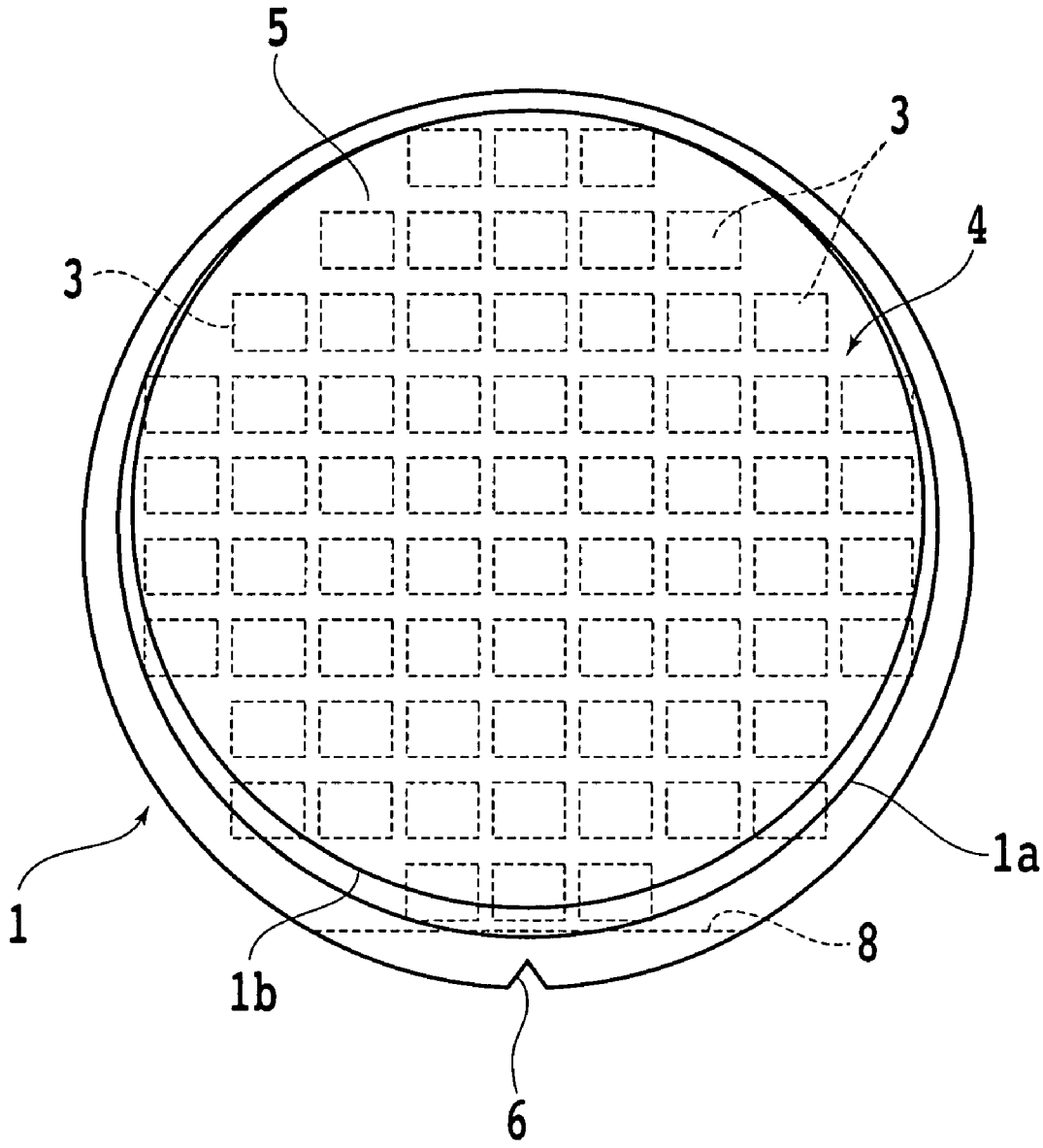
FIG. 5 is a back view of a wafer showing the region of a recess formed in the back side of the wafer in a rough grinding step.

The recess 1A (see FIGS. 6A and 6B) to be formed in the back side of the wafer 1 is regulated in a circular region which corresponds to the device formation region 4 and which avoid the notch 6, like the part drawn with an arcuate line 1*a* in FIG. 5. The recess 1A is eccentric with respect to the wafer 1, and the center of the recess 1A is located at a position slightly deviated to the 180° opposite side of the notch 6. Therefore, the width of the outer peripheral part (the annular projected part denoted by symbol 5A in FIGS. 6A and 6B) where the original thickness is left, formed in the periphery of the recess 1A upon the formation of the recess 1A, is the largest in the vicinity of the notch 6 and is the smallest at a position the farthest from the notch 6.

When the recess 1A is thus formed to avoid the notch 6, generation of chipping starting from the notch 6 during rough grinding can be prevented. The width of the annular projected part 5A is, for example, about 2 to 3 mm, and is on such a level that the chipping starting from the notch 6 is not liable to occur. It is preferable that the width is as small as possible, within such a range that the load at the time of finish grinding will not be high.

After the rough grinding wheel 45 is located in the recess formation permitting position in relation to the wafer 1 located in the rough grinding position, the chuck table 30 is rotated to rotate the wafer 1 in one direction, and, while the rough grinding wheel 45 is rotated at a high speed, the rough grinding unit 40A is lowered by the Z-axis feeding mechanism 60 so as to press the grindstones 45*b* against the back side of the wafer 1.

Figure 6A:
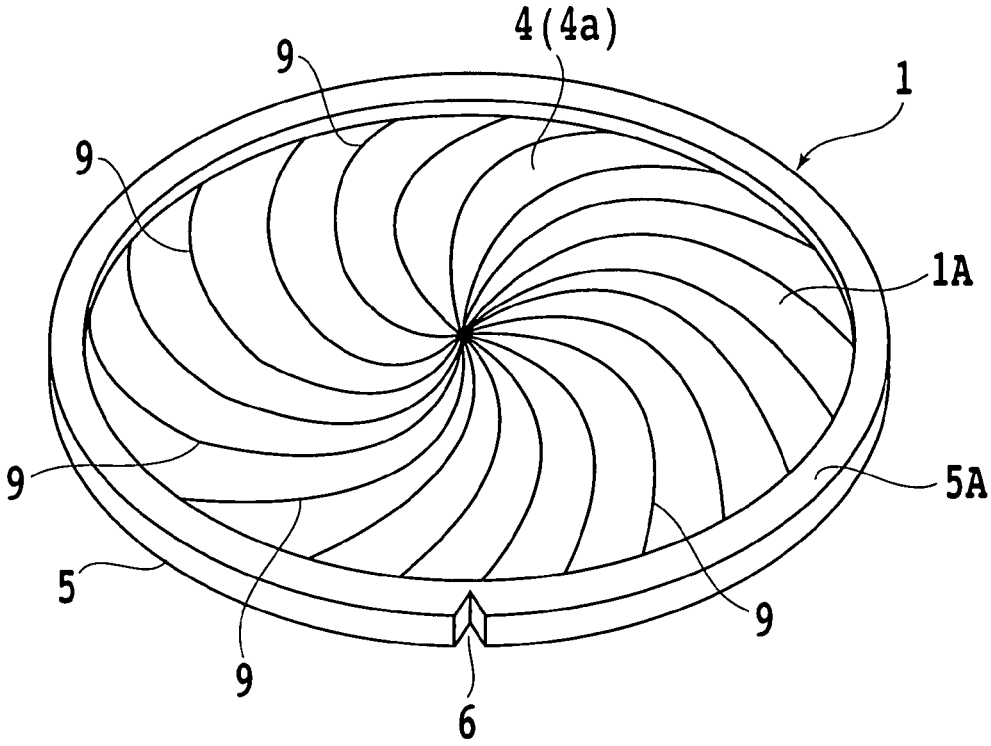
FIG. 6A is a perspective view of a wafer provided with the recess in its back side in the rough grinding step.
Figure 6B:
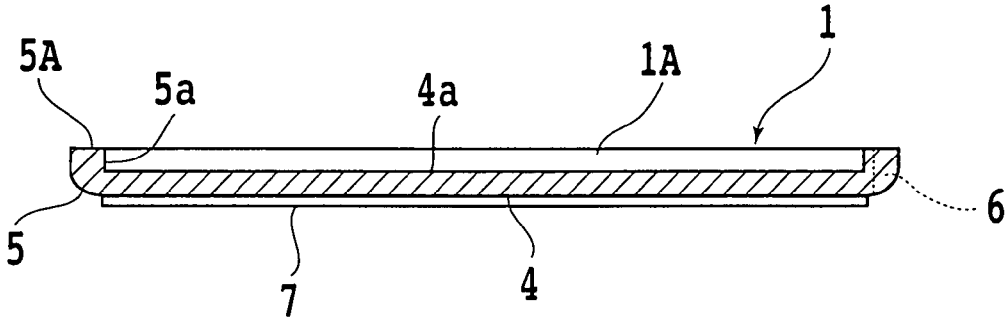
FIG. 6B is a sectional view of the same.

As a result, of the back side of the wafer 1, the circular region drawn with the arcuate line 1A in FIG. 5 is gradually ground, the ground region becomes the recess 1A as shown in FIGS. 6A and 6B, and the annular projected part 5A where the original thickness is left is formed at the outer peripheral part surrounding the recess 1A. The device formation region 4 relevant to grinding in the rough grinding is thinned to, for example, a final finished thickness plus 20 to 40 μm (first grinding step).

The amount of grinding is measured by the thickness gauge 25. When the objective grinding amount is reached during the rough grinding, the lowering of the rough grinding wheel 45 by the Z-axis feeding mechanism 60 is stopped, the rough grinding wheel 45 is kept in rotation for a certain period of time, and then the rough grinding unit 40A is moved upward, to finish rough grinding. As shown in FIG. 6A, in the wafer 1 after the rough grinding, grinding streaks 9 with a multiplicity of arcs drawn in radial patterns are left on a bottom surface 4*a* of the recess 1A. The grinding streaks 9 are traces of crushing by the abrasive grains contained in the grindstones 45*b*, and constitute a mechanically damaged layer including microcracks and the like. The mechanically damaged layer is removed in the subsequent finish grinding.

The wafer 1 for which the rough grinding is finished is transferred to a finish grinding position on the lower side of the finish grinding unit 40B by rotating the turntable 20 in the direction of arrow R. Then, the wafer 1 held on the chuck table 30 at the attaching/detaching position beforehand is transferred to the rough grinding position, and this wafer 1 is subjected to rough grinding concurrently with the finish grinding for the preceding wafer 1. Further, a wafer 1 to be treated followingly is set on the chuck table 30 moved to the attaching/detaching position.

When the wafer 1 is located in the finish grinding position, in relation to the wafer 1, the thickness gauge 25 disposed on the finish grinding side and the finish grinding unit 40B on the upper side thereof are set as follows. Of the thickness gauge 25, the tip of the reference probe 26*a* of the reference-side height gauge 26 is put into contact with the upper surface of the chuck table 30, and the tip of the variation probe 27*a* of the wafer-side height gauge 27 is put into contact with the bottom surface 4*a* of the recess 1A formed.

The finish grinding unit 40B is appropriately moved in the inter-axial direction by the X-axis feeding mechanism 50, to be located in such a position that the cutting edges of the grindstones 46*b* of the finish grinding wheel 46 pass through the rotational center of the wafer 1, whereby the whole surface of the back side of the wafer 1 can be ground. The whole surface grinding permitting position is also located on the outer periphery side of the turntable 20 relative to the rotational center of the wafer 1. Next, the chuck table 30 is rotated to rotate the wafer 1 in one direction, and, while the finish grinding wheel 46 of the finish grinding unit 40B is rotated at a high speed, the finish grinding unit 40B is lowered by the Z-axis feeding mechanism 60.

When the finish grinding unit 40B is lowered, the grindstones 46*b* of the finish grinding unit 40B are pressed against the upper surface of the annular projected part 5A projected upwards, whereby the annular projected part 5A is gradually ground in the manner of being collapsed. In the finish grinding, first, only the annular projected part 5A is ground. When the annular projected part 5A has disappeared, the finish grinding unit 40B is further lowered so as to press the grindstones 46*b* against the whole surface of the back side of the wafer 1 inclusive of the bottom surface 4*a* of the recess 1A, whereby the whole surface of the back side is ground. The objective finish grinding amount, i.e., the grinding amount from the bottom surface 4*a* of the recess 1A is, for example, 20 to 40 μm as above-mentioned (second grinding step).

Figure 7A:
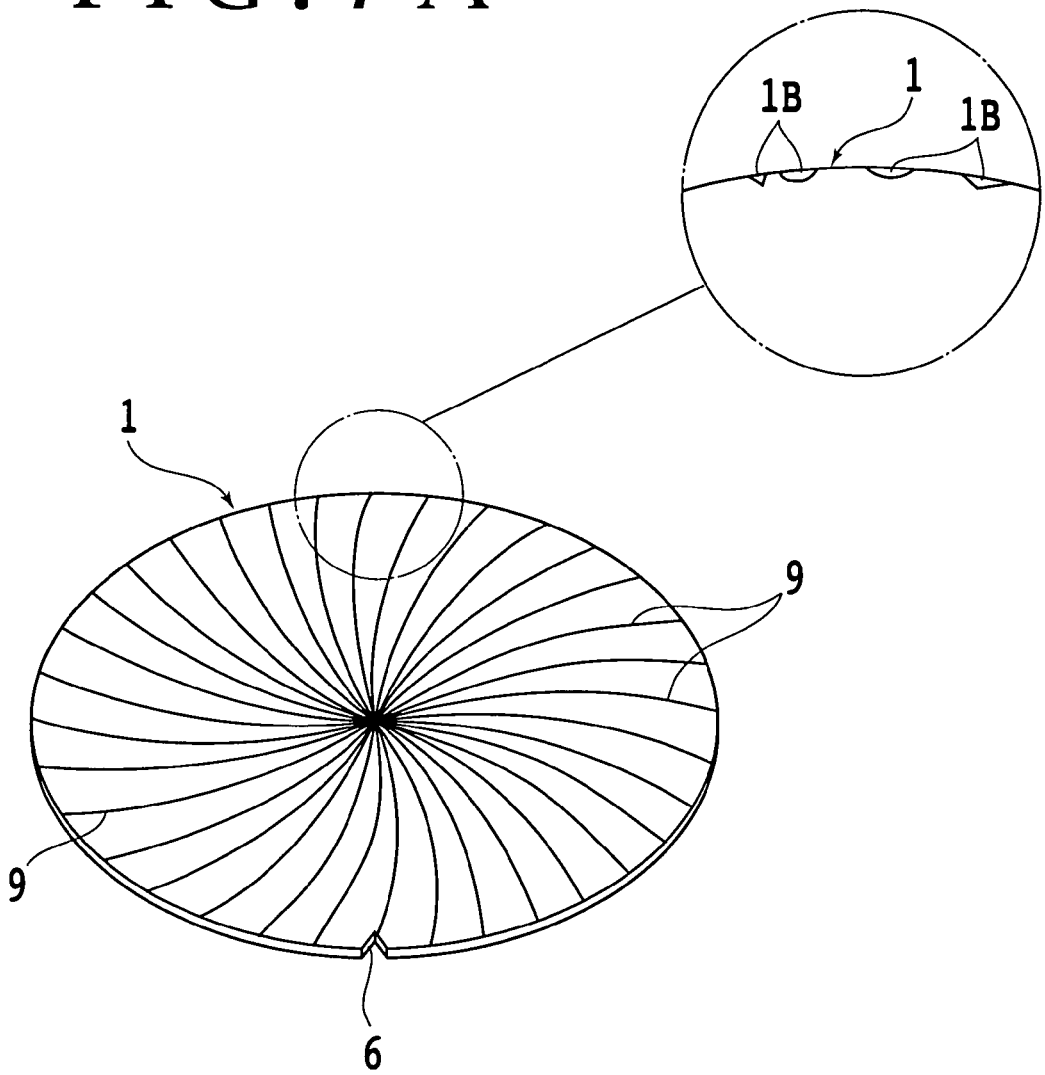
FIG. 7A is a perspective view showing the back side of a wafer after the finish grinding step.
Figure 7B:
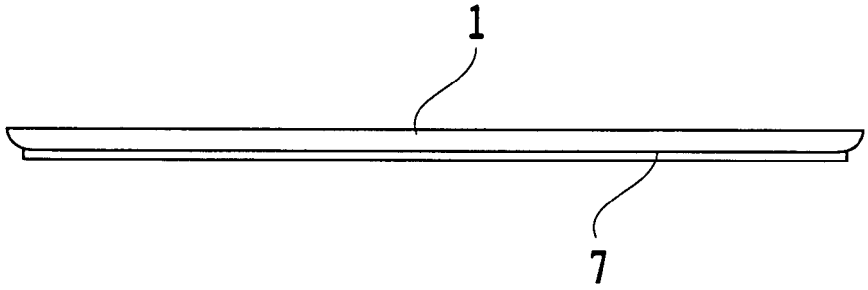
FIG. 7B is a side view of the same.

The amount of grinding after the disappearance of the annular projected part 5A is measured by the thickness gauge 25, and, when it is confirmed that the objective finish grinding amount has been reached, the lowering of the finish grinding wheel 46 by the Z-axis feeding mechanism 60 is stopped, the finish grinding wheel 46 is kept in rotation for a certain period of time, and then the finish grinding unit 40B is raised, to finish the finish grinding. By the finish grinding, the mechanically damaged layer formed by the rough grinding as indicated by the grinding streaks 9 shown in FIG. 6A is removed, and the bottom surface 4*a* of the recess 1A is finished to be a flat mirror finished surface. FIGS. 7A and 7B show a wafer 1 having undergone the finish grinding.

Here, examples of preferred operating conditions for rough grinding and finish grinding will be given. In both the rough grinding unit 40A and the finish grinding unit 40B, the rotating speed of the grinding wheels 45, 46 is about 3000 to 5000 rpm, and the rotating speed of the chuck tables 30 is about 100 to 300 rpm. In addition, the machining feed rate and the lowering rate for the rough grinding unit 40A are 3 to 5 μm/sec. On the other hand, the lowering rate for the finish grinding unit 40B is 4 to 6 μm/sec in the step of grinding the annular projected part 5A, and about 0.5 μm/sec at the final stage of grinding the whole surface of the back side of the wafer 1 after disappearance of the annular projected part 5A.

When the finish grinding and the rough grinding having been carried out concurrently are both finished, the turntable 20 is rotated in the direction of arrow R, and the wafer 1 having undergone the finish grinding is transferred to the attaching/detaching position. By this, the succeeding wafers are transferred respectively to the rough grinding position and the finish grinding position. The wafer 1 on the chuck table 30 located in the attaching/detaching position is transferred by the recovery arm 74 to the cleaning device 75, to be washed with water and dried. The wafer having been cleaned by the cleaning device 75 is transferred and contained into the recovery cassette 76 by the pickup robot 70.

The foregoing is the cycle of grinding the whole surface of the back side of one wafer 1 to thin the wafer to a predetermined thickness. According go the wafer grinding device 10 in this embodiment, the rough grinding of a wafer 1 at the rough grinding position and the finish grinding of another wafer 1 at the finish grinding position are concurrently carried out while intermittently rotating the turntable 20 as above-mentioned, whereby a plurality of wafers 1 are ground efficiently.

In the wafer grinding device 10 according to this embodiment, for formation of the recess 1A in the back side of the wafer 1, the rough grinding wheel 45 of the rough grinding unit 40A is so selected that the outside diameter of grinding by the grindstones 45*b* is slightly smaller than the radius of the wafer 1 and is comparable to the radius of the device formation region 4. Therefore, at the time of grinding wafers different in size (diameter), the rough grinding wheel 45 is replaced with one sized to correspond to the new wafer each time a new kind of wafers are to be ground. In addition, the finish grinding wheel 46 of the finish grinding unit 40B may be an appropriately sized one insofar as the outside diameter of grinding by the grindstones 46*b* is not less than the radius of the wafer 1. In any case, the grinding wheels 45, 46 are located at appropriate grinding positions relative to the back side of the wafer, by appropriately moving the grinding units 40A, 40B in the inter-axial direction by the X-axis feeding mechanism 50.

According to this embodiment in which the back side of the wafer 1 is ground as above-described, the rough grinding by which to ground most of the total grinding amount is applied only to the region, corresponding to the device formation region 4, of the back side of the wafer so as to form the recess 1A and, simultaneously, to leave unground the periphery of the device formation region 4 in the original thickness, thereby forming the annular projected part 5A. Since the outer peripheral edge of the wafer 1 is thus not ground in the rough grinding, the outer peripheral edge is naturally prevented from becoming knife edge-like in shape as the grinding progresses. Therefore, the generation of chipping of the outer peripheral edge frequently experienced during rough grinding according to the related art can be prevented, and rough grinding of the region corresponding to the device formation region 4 constituting a major part of the wafer 1 can be achieved without any trouble.

In the finish grinding after the rough grinding, the whole area of the back side of the wafer 1 is ground by the finishing grindstones 46*b* containing finer abrasive grains, so that chipping of the outer peripheral edge of the wafer 1 is not liable to occur even when the outer peripheral edge becomes knife edge-like in shape. In some cases, chippings (denoted by symbol 1B) of the outer peripheral edge may be generated as shown in FIG. 7A, the chippings are much smaller in depth than those generated during rough grinding in the related art, and the depth of the chippings is, for example, several micrometers. In short, the chippings which may be generated at the outer peripheral edge of the wafer 1 are limited to minute ones generated during finish grinding. Therefore, generation of chippings reaching to the device formation region 4 is restrained, and there is low possibility of breakage of the wafer 1.

In the finish grinding, the annular projected part 5A having the original thickness of the wafer 1 is ground. Therefore, there may be a fear of a high grinding load being exerted on the finishing grindstones 46*b*. Actually, however, the load is not so high, since the width of the annular projected part 5A is as small as 2 to 3 mm and local grinding is simply conducted. Therefore, the finish grinding can be carried out at a feed rate of 4 to 6 μm/sec, which is comparable to that in the rough grinding. After disappearance of the annular projected part 5A, the whole area of the back side of the wafer 1 is ground and, hence, the grinding load is increased. Therefore, the feed rate is set to a low value (about 0.5 μm/sec) suited to the finish grinding.

In the related art, the outer peripheral part of a wafer is cut, whereby the outer peripheral edge is prevented from becoming knife edge-like in shape upon thinning of the wafer, and chipping of the outer peripheral edge is restrained. In this embodiment of the present invention, on the other hand, the process of grinding the back side of a wafer is divided into two stages, whereby chipping of the outer peripheral edge of the wafer is restrained. Thus, a restraining effect on the chipping of the outer peripheral edge of a wafer during grinding process is obtained, without using any step or device other than that for grinding, for example, a step or device for cutting. Therefore, generation of chipping of the outer peripheral edge of the wafer can be restrained without causing a lowering in productivity or a rise in cost; hence, an enhanced yield can be contrived.

While the wafer 1 shown in this embodiment is provided with the notch 6 as a mark indicating the crystal orientation, an orientation flat 8 shown in FIG. 5 may be adopted as the crystal orientation mark in some cases. The orientation flat 8 is formed by cut off a part of the outer peripheral edge of a wafer 1, along a straight line in parallel to the tangential direction. The wafer 1 provided with such an orientation flat 8 is formed with a recess 1A in the part drawn with a circular arc line 1*b* which is retracted from the circular arc line 1*a*, so as to avoid the orientation flat 8. In the wafer provided with the orientation flat 8, the recess 1A formed therein is smaller, and the width of the annular projected part 5A in the vicinity of the orientation flat 8 is greater by a factor of, for example, two folds, as compared with the case where the notch 6 is provided.

In the case where the width of the annular projected part 5A is thus required to be comparatively large, the grinding amount in finish grinding can be controlled more accurately by separately measuring the thickness of the annular projected part 5A at the time of finish grinding. However, the larger width leads to an increase in the load during the finish grinding and an increase in the degree of consumption or wear of the finishing grindstones 46*b*. Therefore, it is needed to set to an appropriate amount the amount of retraction for avoiding the orientation flat 8.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of grinding a wafer having a device formation region provided with a plurality of devices on the front surface thereof, said method comprising the steps of:

holding said wafer on a rotatable chuck table with its back surface exposed;

grinding a region of the back surface of said wafer, corresponding to said device formation region of the front surface, by a plurality of first grindstones arranged in an annular shape to form a circular recess on the back surface of said wafer with an annular projected part remaining in a periphery region of said device formation region, each of said first grindstones including a plurality of first abrasive grains having a first average diameter; and grinding a whole area of the back surface of said wafer inclusive of said annular projected part by a plurality of second grindstones arranged in an annular shape, each of said second grindstones including a plurality of second abrasive grains having a second average diameter smaller than said first average diameter.

2. The method of grinding a wafer as set forth in claim 1, wherein a diameter of said first grindstone is smaller than a radius of said wafer and is comparable to or larger than a radius of said device formation region.

* * * * *